US007584638B2

(12) United States Patent
Madelaine-Dupuich et al.

(10) Patent No.: US 7,584,638 B2
(45) Date of Patent: Sep. 8, 2009

(54) DEVICE AND METHOD FOR CALIBRATING A PLANISHING ROLLER DEVICE BY MEANS OF AN INSTRUMENTED BAR

(75) Inventors: Olivier Madelaine-Dupuich, Metz (FR); Stéphane Rossi, Metz (FR); Gilbert Petig, Plappeville (FR); Philippe Wallendorf, Oeutrange (FR); Dominique Kircher, Talange (FR); Fabrice Tondo, Vitry sur Orne (FR); Eric Vasseur, Plappeville (FR); Alain Fouratier, Hagondange (FR); Jacques-Yves Bourgon, Metz (FR); Christian Hoff, Sérémange (FR)

(73) Assignee: USINOR (FR)

( * ) Notice: Subject to any disclaimer, the term of this patent is extended or adjusted under 35 U.S.C. 154(b) by 184 days.

(21) Appl. No.: 10/548,988

(22) PCT Filed: Mar. 3, 2004

(86) PCT No.: PCT/FR2004/000497

§ 371 (c)(1),
(2), (4) Date: Aug. 15, 2006

(87) PCT Pub. No.: WO2004/080626

PCT Pub. Date: Sep. 23, 2004

(65) Prior Publication Data

US 2007/0033976 A1 Feb. 15, 2007

(30) Foreign Application Priority Data

Mar. 7, 2003 (FR) ..... 03 02845

(51) Int. Cl.
*B21B 15/00* (2006.01)
*B21B 38/00* (2006.01)

(52) U.S. Cl. ..... 72/161; 72/164; 72/31.08

(58) Field of Classification Search ..... 72/31.07–31.09, 72/164, 165, 160, 161, 163, 7.1, 10.1, 10.7, 72/13.4, 14.4; 33/560, 657; 73/862.55, 865.9
See application file for complete search history.

(56) References Cited

U.S. PATENT DOCUMENTS 3,418,850 A * 12/1968 Goddin ..... 73/862.55

(Continued)

FOREIGN PATENT DOCUMENTS

FR 2816856 5/2002

*Primary Examiner*—Dana Ross
*Assistant Examiner*—Debra M Sullivan
(74) *Attorney, Agent, or Firm*—McCormick, Paulding & Huber LLP

(57) ABSTRACT

A device for calibrating a multi-roll leveler for leveling a metal strip includes an assembly having two series of rolls, namely upper rolls and lower rolls which face each other so as to imbricate the rolls of one series into those of the other. The series of rolls are placed substantially parallel to each other and perpendicular to the run direction of the strip to be leveled. A rigid measurement bar of sufficient length is positioned in the leveling direction between the upper and lower rolls, extending over all the rolls, and having rigid protrusions integral with the bar reproducing, when they are placed plumb with the lower rolls, the action of the lower rolls and their mechanical properties. A thin metal plate rests on these protrusions and is fastened to one of them at around the middle of the bar and includes extensometers for measuring its elastic deformations.

14 Claims, 5 Drawing Sheets

U.S. PATENT DOCUMENTS 4,354,315 A * 10/1982 Hecht ..... 33/657
4,901,585 A * 2/1990 Shepard et al. ..... 73/862.632
4,993,270 A * 2/1991 Petit et al. ..... 73/862.55
6,993,947 B2 * 2/2006 Tondo et al. ..... 72/31.07

* cited by examiner

DEVICE AND METHOD FOR CALIBRATING A PLANISHING ROLLER DEVICE BY MEANS OF AN INSTRUMENTED BAR

CROSS-REFERENCE TO RELATED APPLICATIONS

This application is entitled to the benefit of International Application No. PCT/FR2004/000497 filed Mar. 3, 2004 and French Patent Application No. 03/02845 filed on Mar. 7, 2003.

FIELD OF THE INVENTION

The present invention, which falls within the field of metallurgy, and more particularly the manufacture of metal sheet, especially steel sheet, relates to the calibration of a multi-roll leveler, excluding those called multi-roll tension levelers.

BACKGROUND OF THE INVENTION

It is known that levelers are designed to correct or considerably reduce any defects in metal sheet that result from various manufacturing stages (rolling, coiling, heat treatments). Mention may be made, for example, of developable defects (initial bend, "tile") or nondevelopable defects (defects "along the edge" or "along the center").

It will be recalled that the principle of cold leveling consists schematically in converting a geometrical defect into a system of variable residual strains within the thickness by means of alternating bending stresses. The sheet or strip to be leveled thus passes through a stand formed from an assembly comprising at least two series of lower and upper rolls placed facing each other. The two series are arranged so as to be approximately parallel to each other and perpendicular to the run direction of the strip. When the sheet passes between these rolls, it undergoes partial plastic deformation in bending in one direction and then in the opposite direction. The amplitude of the bending progressively decreases because the imbrication of the rolls decreases upon going toward the exit of the leveler. Consequently, it is possible to manufacture products of excellent flatness and with a very low level of residual stresses, capable of meeting certain applications in the fields of metal furniture, domestic electrical appliances and the automobile industry.

The ever tighter product tolerances, in terms of flatness or level of residual stresses, imposed by users, require ever better control of the mechanical behavior of levelers, without which their operation would remain uncertain. At this stage of the description, it seems worthwhile, in order for the various adjustment parameters to be better understood, to describe the main components of a multi-roll leveler.

For this purpose, FIG. 1 shows, in schematic longitudinal section, a conventional leveler comprising a series of lower rolls 11 (identified by 11*a* to 11*n*, there being ten of them in this particular case) and a series of upper rolls 12, identified by 12*a* to 12*m*, supported by a lower beam 13 and an upper beam 14, respectively. The metal strip 10 is driven through the leveler along the direction indicated by the arrow F. The rolls 11 and 12 are mutually imbricated to an extent that decreases along the run direction of the strip. Thus, the strip is significantly deformed by being bent between the entry rolls 11*a*, 12*a*, 11*b*, but very little in the exit rolls 11*m*, 12*m*, 11*n* of the exit zone of the leveler. Consequently, the initial geometrical defects in the strip are converted by plastic deformation into a system of residual strains whose amplitude decreases with that of the bending imposed by the rolls.

FIG. 2 shows schematically known means for adjusting the imbrication of the rolls: the "tilt" characterizes the inclination of the upper beam 14 relative to the lower beam 13 in the run direction of the strip. The lower beam is considered as a reference plane. The beam 14 is supported on an upper frame 15 by adjustment assemblies 16*a*, 16*b*, 16*c* and 16*d*, for example of the screw-nut type with an angle gear or other technologies.

The adjustment assemblies according to the aforementioned example, of the screw-nut type, are actuated by the motors 19*a* and 19*b* by means of drive shafts 17*a* and 17*b*. The couplings 18*a* and 18*b* are used to temporarily decouple the adjustment assemblies that they connect, so as to be able to adjust the transverse parallelism (or "dislocation") between the upper and lower rolls, both on the entry side and on the exit side of the leveler. The imbrication of the rolls is then adjusted by means of the motors, which simultaneously drive the adjustment assemblies at the entry or exit of the leveler.

The dislocation has to be removed by a considerable number of operations on the machine. The tilt is adjusted in a standard fashion in order to modify the imbrication of the rolls, in particular according to the characteristics of the leveled strip.

FIG. 3 shows schematically a conventional leveler in a front view, which illustrates the means available for compensating for the bending of the rolls under load. This is because the reaction forces during strip leveling cause the rolls to deform. To compensate for such deformation, the leveling rolls are supported by stages of support and counter-pressure rolls, ramps or rollers.

This assembly is mounted in a frame called a "cassette" placed on a set of "counter-pressure ramps" that are independent and height-adjustable, these ramps being distributed in the transverse direction of the leveler. FIG. 3 illustrates an example of eleven rows of counter-pressure means 21 for compensating for the bending of the rolls 11. The lateral movement of the rolls is limited by the bearings 20. The vertical position of these ramps can be adjusted, for example by means of adjustable tapered wedges 22.

FIG. 4 shows, in an intentionally exaggerated manner, the deformations created by these counter-pressure ramps on the lower rolls by means of a more or less important vertical displacement of the ramps. The deformations may be produced on the rolls under no load or under load.

FIG. 5 shows a known example in which the height of these counter-pressure means can be adjusted by means of tapered wedges 23 interposed between the support rolls 11 and a rigid lower frame 15'. The relative displacement of the tapered wedges is provided by a cylinder 24 and can be measured, for example, by a position sensor 25.

In the case of a leveler comprising 5 to 6 levels of superposed rolls (case not shown here), eccentric rollers are also present, these bearing on intermediate rolls and making it possible to adjust the clamping of the entry roll 12*a* and the exit roll 12*m*.

Thus, the overall adjustment of a leveler involves many parameters, and in particular:

- the adjustment of the dislocation (transverse parallelism between the upper and lower rolls) carried out for example by screw-nut adjustment assemblies, or counter-pressure ramps;
- the adjustment of the roller imbrication at the entry and at the exit of the leveler by tilting the beam;
- the adjustment of the counter-pressure means in order to compensate for the bending of the rolls under load; and
- the tension in the strip.

To be able to adjust the leveler according to the characteristics of the strip, it is therefore necessary to calibrate or initialize said leveler. This amounts to determining the suitable base adjustments of the leveler in order to obtain the intended effect. It is also desirable to know the adjustment values controllable by the available means (especially imbrication adjustment, counter-pressure rollers height adjustment) and also the amount of play, spring and bending of the rolls during leveling. It is thus possible to take account of these parameters in adjusting the leveler.

To obtain good product flatness therefore requires:

- for the entry and exit gaps of the leveler to be precisely calibrated, for example to ±0.05 mm;
- to check the absence of parasitic tilt or dislocation in beams theoretically parallel from the standpoint of the operator; and
- to precisely calibrate the height of the counter-pressure means, for example to ±0.02 mm.

Now, at the present time, the leveling operations, and in particular the calibration, involve a certain amount of empiricism, for several reasons:

- the preadjustment settings or charts indicated by the manufacturers may prove unsuitable;
- regular checking of the leveler calibration is often performed by the operators, using a ground bar or a round product of calibrated diameter introduced into the gap in order to check the value when the leveling rolls come into contact with this bar. This operation, carried out in the absence of load, therefore does not guarantee that there will be a precise gap when the leveler is under load (clamping onto a product) since the play and spring of the machine are not taken into account in this method. The precision of this calibration method is difficult to quantify, as it is obviously dependent on the sensitivity and the experience of the operators, and its reproducibility is not guaranteed.

However, a method has been proposed ("Modeling of the leveling process and applications to heavy plate mills and strip finishing mills", METEC Düsseldorf 1994) for characterizing levelers under dynamic load and allowing them to be calibrated. This method relies on the use of reference sheets of different formats, which include strain gages placed in line with each counter-pressure means.

Although this method using instrumented sheets is perfectly suitable for defining the initial adjustments of a leveler, it is however poorly suited to regularly monitoring its proper operation. This is because its use requires the machine to be stopped for several hours and a skilled operator has to work on the machine, with sophisticated measurement means, thereby greatly penalizing productivity. In addition, in the case of large levelers, the size of such sheets and the difficulty of manipulating them become a not insignificant problem.

OBJECTS AND SUMMARY OF THE INVENTION

There is therefore a great need to have an easily implementable method that would make it possible:

- to detect any mechanical defects of a leveler;
- to check the calibration of a machine in case of doubt;
- to check that the initially defined adjustments have not drifted over time;
- to carry out this calibration much more rapidly than by the instrumented sheet method, and with a precision and a reproducibility that are much better than with the current manual method using calibrated bars; and
- to accurately adjust the clamping of the entry and exit rolls by acting on eccentrics or equivalent means.

The object of the present invention is to meet these requirements. In particular, the object of the invention is thus to determine, precisely and simply, the characteristics of a leveler by performing a reproducible under-load calibration with known loads.

The object of the invention is also to determine the position of the counter-pressure adjustments so as to be able to correct the bending of the leveling rolls.

The object of the invention is also to correct the "dislocation" of the leveler and to check its "tilt" with parallel beams.

The object of the invention is also in particular to ensure that the initial adjustments have not changed over time.

With these objectives in mind, the subject of the invention is a device for calibrating a multi-roll leveler for leveling a metal strip, comprising at least one assembly consisting of two series of rolls, namely lower rolls and upper rolls, placed facing each other so as to imbricate the rolls of one series into those of the other, these series of rolls being placed substantially parallel to each other and perpendicular to the run direction of the strip to be leveled, said device being characterized in that it furthermore includes a rigid measurement bar of sufficient length to be positioned in the leveling direction between said set of said upper and lower rolls, extending over all the rolls, rigid protrusions integral with the bar reproducing, when they are placed plumb with the lower rolls, the action of said lower rolls and their mechanical properties, and a thin metal plate that rests on these protrusions and is fastened to one of them at around the middle of the bar, said thin metal plate having extensometers for measuring its elastic deformations.

According to a preferred feature of the invention, the length of the instrumented thin plate is greater than the distance separating the first roll from the last roll of the leveler, the width of said plate preferably being less than that of a counter-pressure ramp or roller.

According to another advantageous feature of the invention, the geometrical and mechanical characteristics of said thin plate are chosen in such a way that, when this thin plate is subjected to a force corresponding to the leveling of strips with the lowest thickness, lowest yield strength and lowest elastic modulus that are treated in the leveler, these result in a deformation within the elastic region of the material of the plate.

According to another advantageous feature of the invention, the extensometers may be strain gages based on a change in resistance, or fiber-optic extensometers that measure the change in length of a Fabry-Perot cavity, or any other means for measuring the local deflection of said thin plate.

According to another feature of the invention, the bar includes an alignment stud that is inserted between two lower rolls in order to position said bar in a precise and reproducible manner along the longitudinal direction of said leveler.

According to another feature of the invention, at least two extensometers are positioned at the center and on the lower part of the plate, so that, once the instrumented bar is in place in the leveler, the extensometers are located in line with the fourth roll from the entry of the leveler and with the N-3$^{th}$ roll from the exit of the leveler, said leveler having in total N rolls.

Advantageously, at least two extensometers are positioned at the center and on the lower part of the plate, so that, once the instrumented bar is in place in the leveler, said extensometers are located in line with the second roll from the entry of the leveler and with the N-1$^{th}$ roll from the exit of the leveler, said leveler having in total N rolls.

According to another feature of the invention, the bar advantageously includes an extension for easily manipulating it within the leveler.

The subject of the invention is also a method for calibrating a multi-roll leveler using the instrumented-bar device defined above, characterized in that two such measurement bars, including a thin instrumented plate, are positioned near the bearings in the leveler, the counter-pressure ramps being completely lowered, the series of lower rolls and upper rolls are brought close together by acting on the clamping control means so as to exert a force on said measurement bars, this reference force corresponding to the leveling of strips having the lowest thickness, lowest yield strength and lowest elastic modulus that can be treated in the leveler, said plate being in a state of elastic deformation. Once this force is reached, the deformations of the bars are measured by means of said extensometers in order to deduce therefrom a reference gap, the dislocation and the tilt of said leveler, and, where appropriate, to apply corrections according to these results.

According to a preferred method of implementation, the calibration step defined above is carried out and then, in a subsequent step, the two measurement bars, including an instrumented plate, are positioned plumb with the counter-pressure ramps closest to the bearings and the two series of lower rolls and upper rolls are brought close together by acting on the clamping control means in order to bring them to the reference gap measured in the previous step, the displacements of the two aforementioned counter-pressure ramps are then varied in order to obtain a force identical to the reference force, measured from the deformations of the instrumented thin plate, and, by lateral displacement of the bars plumb with the other counter-pressure ramps, this operation is repeated as many times as necessary until all of the counter-pressure means have been calibrated.

According to another method of implementation, as many measurement bars, including an instrumented thin plate and defined above, are used as there are counter-pressure ramps, two said measurement bars are positioned close to the bearings in the leveler, the two series of rolls are brought close together by acting on the clamping control means so as to exert a reference force on the measurement bars, said force corresponding to the leveling of strips having the lowest thickness, lowest yield strength and lowest elastic modulus that are treated in said leveler, and, the plate being in a state of elastic deformation, the deformations undergone by the plates are measured by means of the extensometers in order to deduce therefrom the reference gap, and if appropriate to correct the dislocation and the tilt of said leveler, next, all of the measurement bars are placed in the leveler, positioned respectively in line with each counter-pressure ramp, the two series of rolls are brought close together by acting on the clamping control means in order to obtain the reference gap, the displacements of the counter-pressure means are varied in order to obtain the reference force, and the deformations undergone by the plates are measured by means of the extensometers in order to deduce therefrom the gap and the clamping force applied by the rolls and, where appropriate, corrections are applied to the calibration according to the results thus obtained.

Advantageously, the calibration methods described above are implemented using bars that include an alignment stud, which is inserted between two of the lower rolls in order to position each bar in a precise and reproducible manner along the longitudinal direction of the leveler, in such a way that the rigid protrusions reproducing the action of the lower rolls are placed in line with these rolls.

BRIEF DESCRIPTION OF THE DRAWINGS

The invention will now be described more precisely, but not limitingly, with reference to the plates of drawings appended hereto, in which.

DETAILED DESCRIPTION OF THE INVENTION

Figure 1:
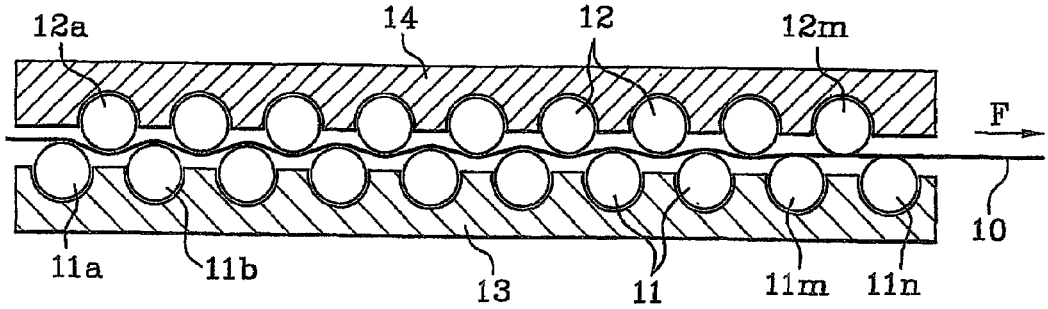
Figure 1 Prior Art
FIGS. 1 to 5, which illustrate the principle and the construction of a known multi-roll leveler, have already been commented upon previously.
Figure 2:
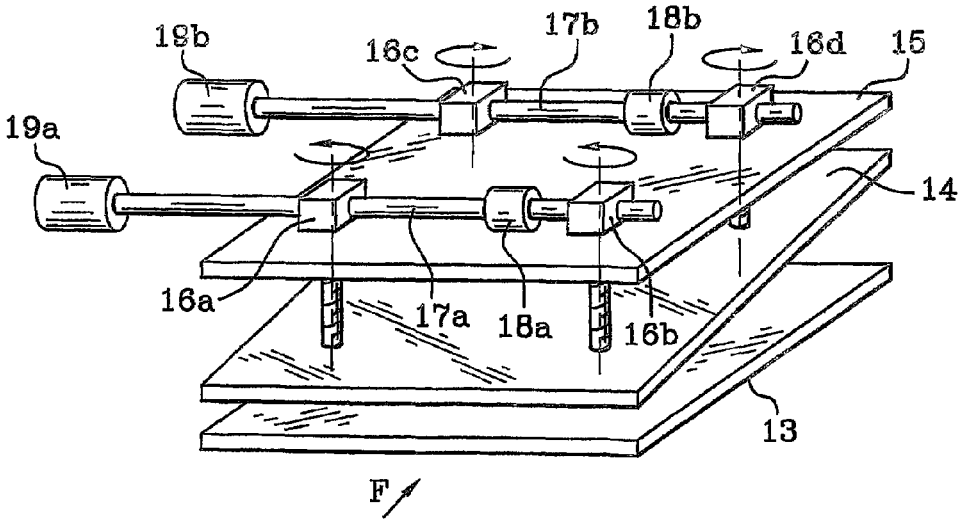
Figure 2 Prior Art
Figure 3:
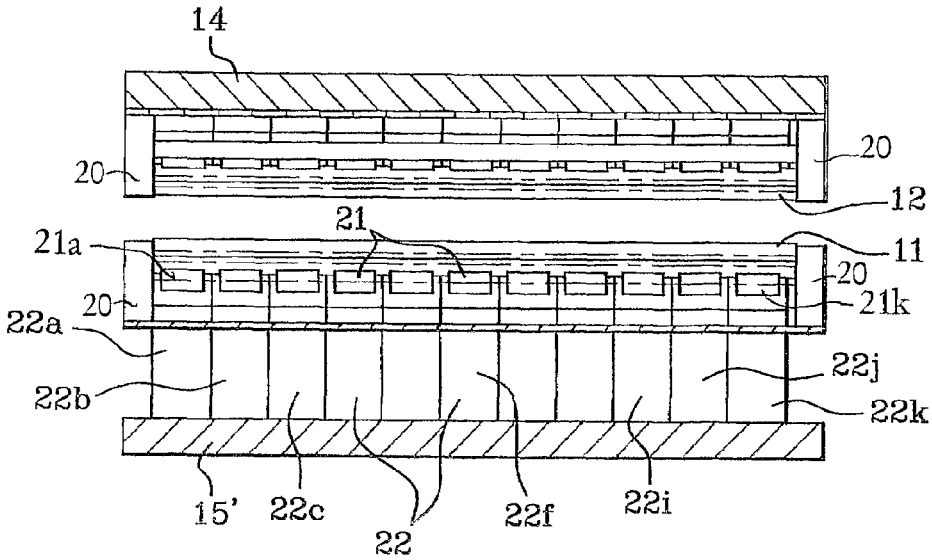
Figure 3 Prior Art
Figure 4:
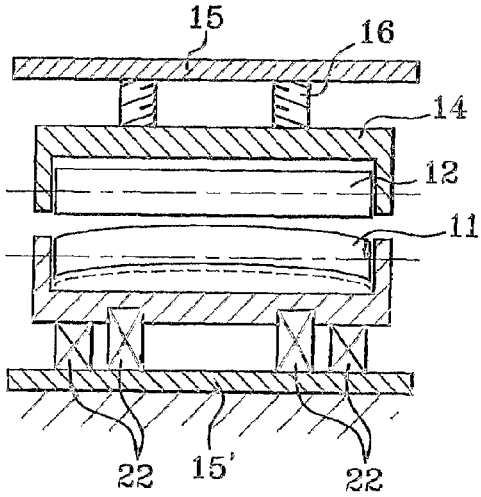
Figure 4 Prior Art
Figure 5:
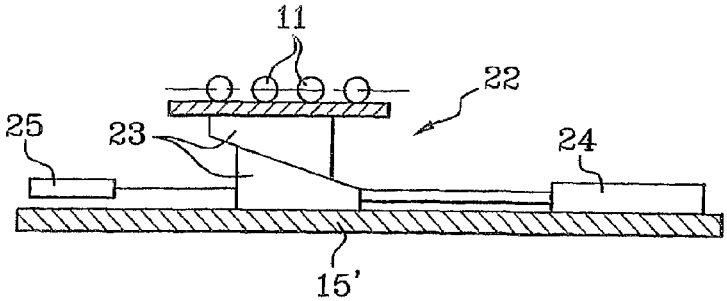
Figure 5 Prior Art
Figure 6:
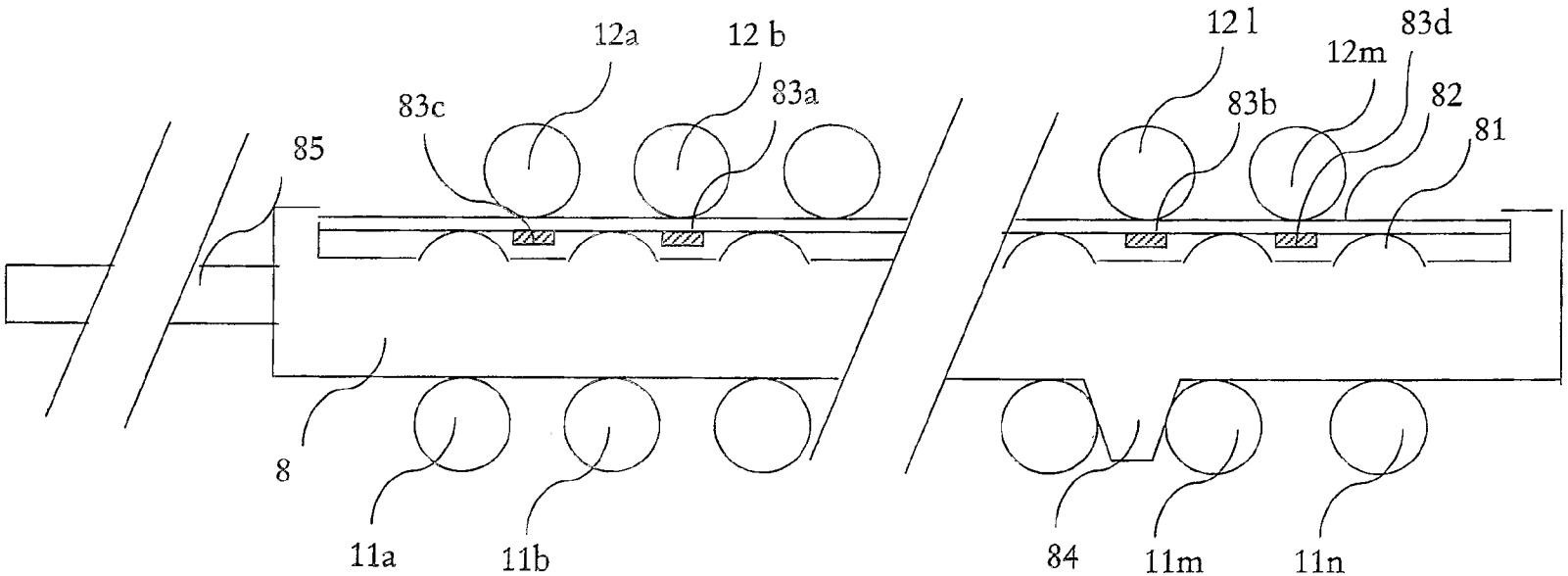
FIG. 6 shows an instrumented-bar device according to the invention and the way in which it is positioned in a multi-roll leveler.

The device illustrated in FIG. 6 consists firstly of a rigid bar 8, for example made of steel, having a length greater than that of the leveler. This rigid bar includes fixed protrusions 81, also rigid, the spacing of which faithfully reproduces the center-to-center distance of the rolls 11 of the lower beam of the leveler. The geometry of these protrusions is preferably chosen so as to create a linear contact with a thin plate that rests on them. For example, cylindrical protrusions are chosen that have a diameter close to that of the rolls of the leveler. The general design of the bar is made on the basis of the leveling conditions for the range of products that require the least load (minimal bending of the leveling rolls).

Figure 7:
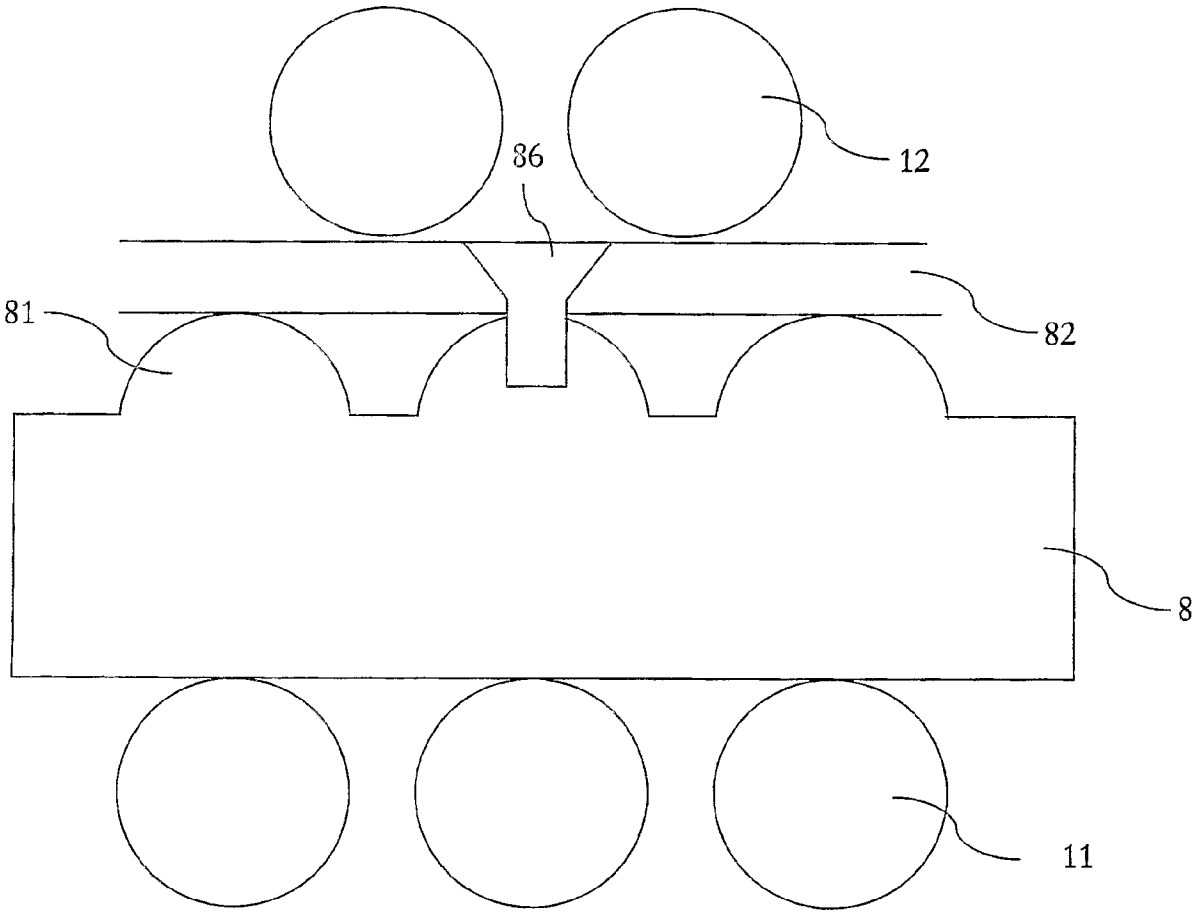
FIG. 7 illustrates one way of fastening the thin plate to one protrusion of the instrumented bar.

A thin plate 82 rests on the protrusions 81. The presence of this plate simulates that of a thin product in linear contact with protrusions having a hardness comparable to that of the leveling rolls. The total length of this plate is greater than the distance separating the axis of the first roll from that of the last roll. The width of the plate, defined so that the overall support is sufficiently rigid, does not exceed the width of a counter-pressure means. The thin plate is integral with the bar, by being fastened to a single central protrusion of the bar, so as to allow free deformation of the plate on either side of the fastening point during clamping. This plate is fastened by a screw 86 as illustrated in FIG. 7, or by any other equivalent system.

The characteristics of this metal plate are chosen according to the following points. As mentioned above, the stresses of this plate are those defined by the leveling conditions for the range of products that require the least load. By definition, these conditions result in the plastic deformation of the leveled products. The characteristics of the plate must however be chosen in such a way that these same conditions result only in its deformation within the elastic range. This means that at least one of the following characteristics of the plate—namely the yield strength, the thickness and the elastic modulus—must be greater than those of the leveled products.

Advantageously, the device includes an extension 85 that allows it to be easily manipulated, for example in order to move it transversely within the leveler. This extension also serves to provide the electrical connections to the strain gages.

FIG. 6 shows the device resting on the lower series of rolls 11 of the leveler. To ensure that it is precisely positioned, longitudinally with respect to the subjacent rolls, it is useful to employ a positioning system. This is, for example, an alignment stud 84 integral with the bar, which is inserted between two lower rolls 11 of the leveler. In this way, the bar is positioned longitudinally in a precise and reproducible manner, the rigid protrusions reproducing the action of the lower rolls being perfectly placed plumb with these rolls. However, it is obvious that equivalent positioning means may be employed, provided that a comparable level of precision is met.

As may be seen, two extensometers 83*a* and 83*b* (for example strain gages, fiber-optic strain gages, which measure the change in length of a Fabry-Perot cavity, or any other means for measuring the local deflection of the thin plate) are fastened to the lower part of the thin plate. Their precise location corresponds to the following data:

the two extensometers are placed as close as possible to the ends (entry and exit) of the leveler, so as to measure, by difference, the tilt of the machine as precisely as possible;

to obtain the greatest possible precision, the extensometers are placed in a region highly stressed in bending. Thus locating them at mid-distance between two upper and lower rolls (zero deformation) would not meet the desired objective;

advantageously, the extensometers are positioned on part of the thin plate that is stressed in tension. Although it is theoretically possible to locate them on a part stressed in compression, the difficulties in positioning them on a surface directly in contact with the rolls make this option substantially more difficult to implement;

it is also recommended to locate the extensometers at a point considered as being completely embedded, the boundary conditions of which are defined only by the positions of the rolls. This condition is not met in line with the rolls 12*a* and 12*m* in FIG. 6, since the sheet is free beyond rolls 11*a* and 11*n*. This condition is however fulfilled in line with rolls 12*b* and 12*l*. More generally, if N denotes the total number of rolls of the leveler (i.e. m+n is the sum of the number of rolls of the upper and lower series), 1 denoting the entry roll, and N the exit roll, the extensometers are preferably located on that face in extension of the thin plate in line with the fourth roll (and therefore on the entry side of the leveler) and in line with the N-3$^{th}$ roll (on the exit side of the leveler). The extensometers are placed at the center of the plate, in line with the two abovementioned rolls, in order to measure the local extreme bending deformation;

however, it may also be advantageous to place extensometers in regions where the clamping has to be controlled more strictly, and where specific means are placed for acting thereon. This is the case at the leveler entry or exit, where the clamping may be modified especially by an eccentric acting indirectly on the rolls 12*a* and 12*m*. In this case, it may be advantageous to place extensometers at the center of the plate, in line with the two abovementioned rolls (83*c* and 83*d*, in FIG. 6) in order to measure the local deformation. If this is significantly different from that measured at any other longitudinal point on the bar in line with a roll (for example level with rolls 12*b* and 12*l*), it will be concluded from this that there is imperfect adjustment of the eccentric, (for example by overclamping it), which will have to be modified.

The total thickness of the device (bar+protrusions+plate+alignment system) is large enough to guarantee the stiffness of the assembly, while still remaining compatible with the maximum opening available in the leveler.

To carry out a measurement, the bar 8 is placed between the lower and upper rolls of the leveler. The stop 84 (or equivalent positioning system) positions the bar relative to these rolls and thus ensures that the entire bar is properly placed longitudinally relative to the leveler. Since the transverse position of a bar relative to a counter-pressure ramp is not critical, it may be positioned by placing the bar along the axis of the counter-pressure means using a standard measuring device or an equivalent system.

The following procedure describes a first step intended to determine and correct the dislocation and the tilt of a leveler:

two measurement bars 8 with an instrumented plate are placed in the leveler, these being placed as close as possible to the bearings 20, with the counter-pressure ramps 21 fully lowered. In a first step, the two series of rolls 11 and 12 are brought close together by acting on the clamping control means (motors 19*a* and 19*b*) so as to exert a leveling force. To ensure the greatest precision in the calibration method, this reference leveling force is chosen so as to reproduce the lowest force within the industrial application range of the leveler, which corresponds to the leveling of the thinnest products with the lowest elastic modulus and the lowest yield strength. The deformations measured on the bars 8 make it possible to deduce therefrom a value of the gap (which is termed the reference gap). By examination and comparison of the reference gap values measured along the longitudinal and transverse directions of the leveler, it is possible to correct the dislocation and the tilt of the leveler, for example by means of adjustments 16*a*, 16*b*, 16*c*, 16*d* of the screw/nut type or by equivalent devices.

The following procedure describes a subsequent step, aiming to determine the gap and the clamping force applied by the rolls in line with the counter-pressure means.

Two measurement bars 8 are positioned plumb with the first and second counter-pressure ramps 21*a* and 21*k* closest to the bearings. The two series of lower rolls 11 and upper rolls 12 are brought close together by acting on the clamping control means in order to bring them to the reference gap measured in the previous step. The displacements of the counter-pressure means 21*a* and 21*k* in question are varied so as to obtain the reference force, the measurement being carried out on the basis of the deformations of the instrumented thin plate 82 of the bars 8. This step is repeated, by laterally displacing the bars in line with two other counter-pressure means 21 as many times as necessary, until all of the counter-pressure means 21 have been calibrated.

For the purpose of carrying out the calibration and the adjustments more rapidly, it is also possible to employ as many measurement bars 8 including an instrumented thin plate 82 as there are counter-pressure ramps 21. The first step remains the same as that described above, whereas the next step consists in placing a bar 8 beneath each ramp 21.

Figure 8:
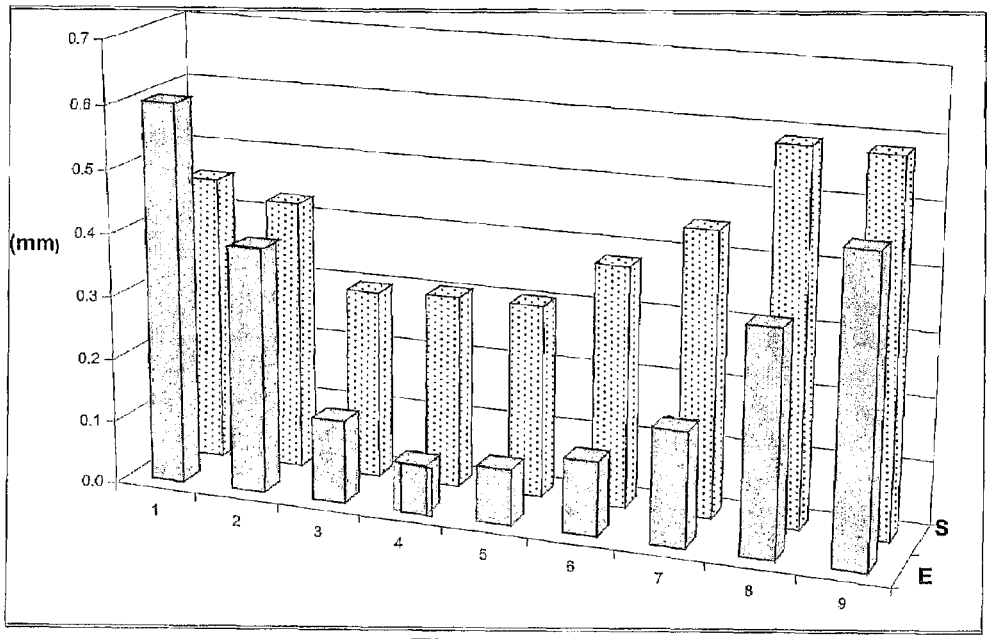
FIG. 8 illustrates the clamping measured on a leveler by means of the invention, the counter-bending ramps being fully lowered.

As an example, the following results illustrate the invention: the device and the method were used so as to characterize a multi-roll leveler. In FIG. 8, the numerical indicators 1 and 9 correspond to plumb with the first and last counter-pressure ramps of this leveler, while the numerical indicator 5 denotes the longitudinal axis of the leveler. FIG. 8 illustrates the transverse variation in the clamping measured at the entry (E) and at the exit (S) of this leveler by means of instrumented-plate bars, the counter-bending ramps being fully lowered. This first step makes it possible to identify any bending of the rolls under load and also any twisting of the leveler cassette.

Figure 9:
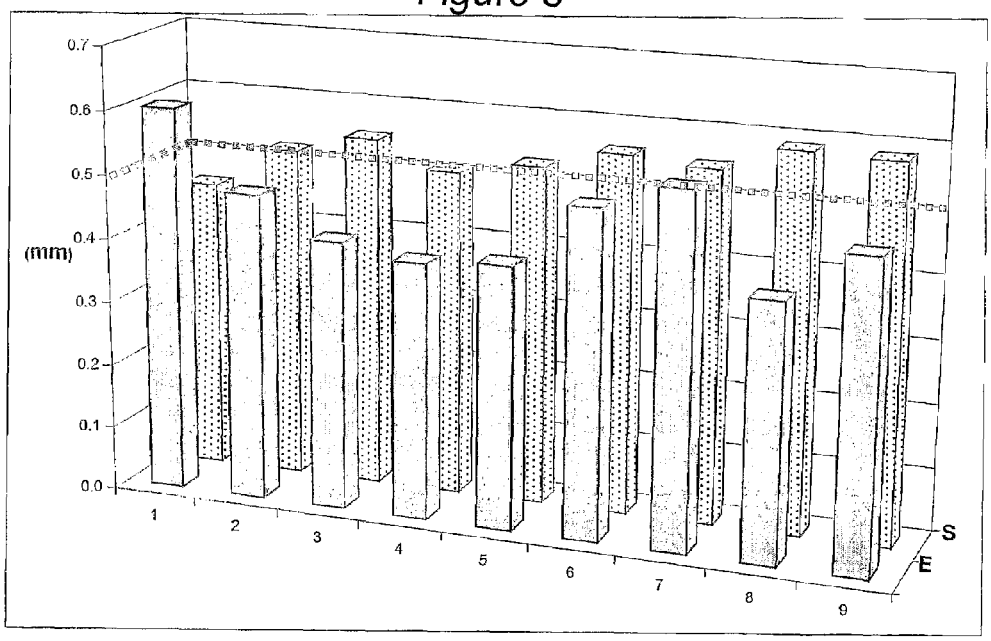
FIG. 9 illustrates the clamping measured on a leveler by means of the invention, after homogenization in both the longitudinal and transverse directions.

FIG. 9 illustrates the clamping measured on the same leveler, after correction made to the counter-pressure means, taking into account the indications from the above characterization step. The bending of the rolls and the gap of the machine under load have been made uniform. The clamping on the instrumented bars after this calibration operation is 0.5 mm±0.1 mm.

It goes without saying that the invention is not limited to the examples described above, but extends to many equivalent alternative versions provided that its definition, given in the following claims, is reproduced. Thus, the invention described makes it possible to rapidly identify and correct any adjustment defects in multi-roll levelers. Being simple to use for the operator, it makes it possible to establish a diagnostic of any drift and to significantly increase the quality of the leveled products, by achieving better flatness and greater regularity.

The invention claimed is:

1. A device for calibrating a multi-roll leveler for leveling a metal strip, said device comprising at least one assembly consisting of two series of rolls, namely lower rolls and upper rolls, placed facing each other so as to imbricate the rolls of one series into those of the other, said series of rolls being placed substantially parallel to each other and perpendicular to the run direction of the strip to be leveled, wherein said device furthermore includes at least one rigid measurement bar of sufficient length to be positioned in said leveling direction between said assembly of said upper and lower rolls, extending over all the rolls, rigid protrusions integral with the bar reproducing, when they are placed plumb with the lower rolls, the action of said lower rolls and their mechanical properties, and an instrumented plate that rests on these protrusions and is fastened to one of them at around the middle of the bar, said instrumented plate having extensometers for measuring its elastic deformations.

2. The device as claimed in claim 1, wherein said instrumented plate has a length greater than the distance separating the axis of the first roll from that of the last roll of said leveler, and said instrumented plate has a width less than that of a counter-pressure ramp or roller.

3. The device as claimed in claim 1, wherein geometrical and mechanical characteristics of said instrumented plate are chosen in such a way that, when said instrumented plate is subjected to a force corresponding to the leveling of strips with the lowest thickness, lowest yield strength and lowest elastic modulus that are treated in said leveler, these result in a deformation within the elastic region of the material of said plate.

4. The device as claimed in claim 1, wherein said extensometers are strain gages based on a change in resistance.

5. The device as claimed in claim 1, wherein said extensometers are fiber-optic extensometers that measure the change in length of a Fabry-Perot cavity.

6. The device as claimed in claim 1, wherein said extensometers are means for measuring the local deflection of said thin plate.

7. The device as claimed in claim 1, wherein said bar includes an alignment stud that is inserted between two of said lower rolls in order to position said bar in a precise and reproducible manner along the longitudinal direction of said leveler.

8. The device as claimed in claim 1, wherein at least two of said extensometers are positioned at the center and on the lower part of said plate, so that, once said bar is in place in said leveler, said extensometers are located in line with a fourth roll from the entry of said leveler and with a N-3$^{rd}$ roll from the exit of said leveler, said leveler having in total N rolls.

9. The device as claimed in claim 1, wherein at least two of said extensometers are positioned at the center and on a lower part of the plate, so that, once said bar is in place in the leveler, said extensometers are located in line with a second roll from the entry of said leveler and with a N−1$^{st}$ roll from the exit of said leveler, said leveler having in total N rolls.

10. The device as claimed in claim 1, wherein said rigid bar includes an extension for manipulating it within said leveler.

11. A method for calibrating a multi-roll leveler, using the device as claimed in claim 1, wherein said at least one measurement bar is two measurement bars, said method comprising the steps of:

positioning said two measurement bars, including an instrumented plate, near bearings in said leveler, counter-pressure ramps being completely lowered;

bringing the series of lower rolls and upper rolls close together by acting on a clamping control means so as to exert a reference force on said two measurement bars, said reference force corresponding to the leveling of strips having the lowest thickness, lowest yield strength and lowest elastic modulus that can be treated in said leveler, said plate being in a state of elastic deformation; and measuring the deformations of said bars once said reference force is reached by means of said extensometers in order to deduce therefrom a reference gap, the dislocation and the tilt of said leveler, and, where appropriate, to apply corrections according to these results.

12. The method of calibrating a leveler as claimed in claim 11, further comprising the steps of:

positioning said two measurement bars, including an instrumented plate, in said leveler, transversely and plumb with said counter-pressure ramps closest to said bearings;

bringing the two series of lower rolls and upper rolls close together by acting on the clamping control means until said reference gap is obtained;

varying displacements of the counter-pressure ramps respectively so as to obtain said reference force measured from the deformations of the plate; and moving said bars laterally beneath said other counter-pressure ramps, and applying said force to determine the gap and the clamping force applied by the rolls in line with each said counter-pressure ramp of the leveler.

13. The method of calibrating a multi-roll leveler using the device as claimed in claim 11, wherein said at least one measurement bar, including an instrumented plate, is a plurality of measurement bars corresponding to the number of counter-pressure ramps, said method further comprising the steps of:

positioning said two measurement bars including a thin instrumented plate close to the bearings in said leveler;

bringing the two series of rolls close together by acting on the clamping control means so as to exert a reference force on said measurement bars, said force corresponding to the leveling of strips having the lowest thickness, lowest yield strength and lowest elastic modulus that are treated in said leveler, said plate being in a state of elastic deformation;

measuring the deformations undergone by said plates by means of said extensometers in order to deduce therefrom the reference gap, and to correct the dislocation and the tilt of said leveler;

placing said plurality of measurement bars corresponding to the number of said counter-pressure ramps in the leveler, said plurality of measurement bars positioned respectively in line with each said counter-pressure ramp;

bringing the two series of rolls close together by acting on the clamping control means in order to obtain said reference gap;

varying the displacements of the counter-pressure ramps in order to obtain said reference force; and measuring the deformations undergone by said plates by means of said extensometers in order to deduce therefrom the gap and the clamping force applied by the rolls and, where appropriate, corrections are applied to the calibration according to the results thus obtained.

14. The method of calibrating a leveler as claimed in claim 11, wherein said bar of said device comprises an alignment stud and said device is inserted between two of said lower rolls in order to position, by means of said alignment stud, said bar in a precise and reproducible manner along the longitudinal direction of said leveler and in such a way that the rigid protrusions reproducing the action of the lower rolls are placed in line with these rolls.

* * * * *